US008070259B2

(12) United States Patent
Mulay et al.

(10) Patent No.: US 8,070,259 B2
(45) Date of Patent: Dec. 6, 2011

(54) METHODS AND APPARATUS FOR IMPROVED EJECTION HEAD PLANARITY AND REDUCED EJECTION HEAD DAMAGE

(75) Inventors: Shirish Padmakar Mulay, Lexington, KY (US); Bhaskar Ramakrishnan, Wilsonville, OR (US)

(73) Assignee: Lexmark International, Inc., Lexington, KY (US)

( * ) Notice: Subject to any disclaimer, the term of this patent is extended or adjusted under 35 U.S.C. 154(b) by 1119 days.

(21) Appl. No.: 11/853,867

(22) Filed: Sep. 12, 2007

(65) Prior Publication Data

US 2009/0066759 A1 Mar. 12, 2009

(51) Int. Cl.
*B41J 2/16* (2006.01)

(52) U.S. Cl. ..... 347/49
(58) Field of Classification Search ..... 347/49
See application file for complete search history.

(56) References Cited

U.S. PATENT DOCUMENTS 6,557,989 B1 * 5/2003 Hirosawa et al. ..... 347/87
* cited by examiner

*Primary Examiner* — Jerry Rahll

(57) ABSTRACT

A micro-fluid ejection head assembly having improved assembly characteristics and methods of manufacturing a micro-fluid ejection head assembly. The micro-fluid ejection head includes a fluid supply body having at least one fluid supply port in a recessed area therein. A reinforcing member circumscribes the fluid supply port. A micro-fluid ejection head is attached with an adhesive to the supply body in the recessed area so that cracking of the ejection head during adhesive curing is substantially reduced.

14 Claims, 7 Drawing Sheets

METHODS AND APPARATUS FOR IMPROVED EJECTION HEAD PLANARITY AND REDUCED EJECTION HEAD DAMAGE

TECHNICAL FIELD

The disclosure relates to micro-fluid ejection head structures and in particular to apparatus and methods that are effective for improving the planarity of ejection heads and reducing ejection head damage.

BACKGROUND AND SUMMARY

Micro-fluid ejection heads for micro-fluid ejection devices such as ink jet printers continue to be improved as the technology for making the ejection heads continues to advance. New techniques are constantly being developed to provide low cost, highly reliable micro-fluid ejection head structures that can be manufactured in high yield with a relatively low amount of spoilage or ejection head damage.

In order to increase ejection head speed and volume output, larger ejection heads having an increased number of ejection actuators are being developed. However, as the ejection head size and number of ejection actuators increases, manufacturing apparatus and techniques are required to meet increased tolerance demands for such ejection heads. Slight variations in tolerances of parts may have a significant impact on the operation and yield of suitable ejection head products.

The primary components of the micro-fluid ejection head are a substrate or chip containing fluid ejector actuators, and a nozzle plate and a flexible circuit attached to the chip. The chip is typically made of silicon and contains various passivation layers, conductive metal layers, resistive layers, insulative layers and protective layers deposited on a device surface thereof. For thermal micro-fluid ejection heads, individual heaters are defined in the resistive layers and each heater resistor corresponds to a nozzle hole in the nozzle plate for heating and ejecting fluid from the ejection head toward a target media. In a top-shooter type ejection head, nozzle plates are attached to the chips and there are fluid chambers and fluid feed channels for directing fluid to each of the heaters on the chip either formed in the nozzle plate material or in a separate thick film layer. In a center feed design for a top-shooter type ejection head, fluid is supplied to the channels and chambers from a slot or via that is conventionally formed by chemically etching or grit blasting through the thickness of the chip. The chip, nozzle plate and flexible circuit assembly is typically bonded to a thermoplastic body using a heat curable and/or radiation curable adhesive to provide a micro-fluid ejection head structure.

Attaching the chips to the body and curing the adhesive is a delicate procedure and may result in chip cracking and thus product yield loss. As the size of the chips increase, the difficulty associated with handling the chips without damage or breakage also increases. Larger chips require even more care when attaching the chips to a thermoplastic body so as to minimize chip cracking and warpage.

It is believed that a predominant contributor of chip warpage is the coefficient of thermal expansion mismatch between the chip and the thermoplastic body. During manufacturing, when the chip and body go through the adhesive cure cycle, chip warpage is introduced as the components cool. If the displacement for the chip from a planar configuration is too large, the chip cracks. Accordingly, there continues to be a need for improved manufacturing processes and techniques which provide improved ejection head components and structures without product loss due to chip cracking.

With regard to the above, there is provided a micro-fluid ejection head assembly having improved assembly characteristics and methods of manufacturing a micro-fluid ejection head assembly. The micro-fluid ejection head includes a fluid supply body having at least one fluid supply port in a recessed area therein. A reinforcing member circumscribes the fluid supply port. A micro-fluid ejection head is attached with an adhesive to the supply body in the recessed area so that cracking of the ejection head during adhesive curing is substantially reduced.

In another embodiment, there is provided a method for improving micro-fluid ejection assembly yield. The method includes providing a fluid supply body having a fluid supply port in a recessed area thereof therein and a reinforcing member circumscribing the fluid supply port. A micro-fluid ejection head is adhesively attached to the fluid supply body in the recessed area. The method may provide a substantially improved yield of usable micro-fluid ejection assemblies.

An advantage of the foregoing structure and method therefor is that chip warpage and thus chip cracking may be substantially reduced without the need to select materials having similar coefficients of thermal expansion. The structures and methods provided herein may be used with a wide variety of thermoplastic body materials and chip substrate materials to reduce warpage of the chip substrate during adhesive curing cycles. A wider variety of stiffener materials may be used with the thermoplastic bodies to maintain substantially lower chip warpage as compared to materials selected for a coefficient of thermal expansion that is similar to the coefficient of thermal expansion of the chip material

BRIEF DESCRIPTION OF THE DRAWINGS

Further advantages of the disclosure may be apparent by reference to the detailed description of preferred embodiments when considered in conjunction with the following drawings, in which like reference numbers denote like elements throughout the several views, wherein features have been exaggerated for ease of understanding and are not intended to be illustrative of relative thicknesses of the features, and wherein.

DETAILED DESCRIPTION OF THE PREFERRED EMBODIMENTS

Figure 1:
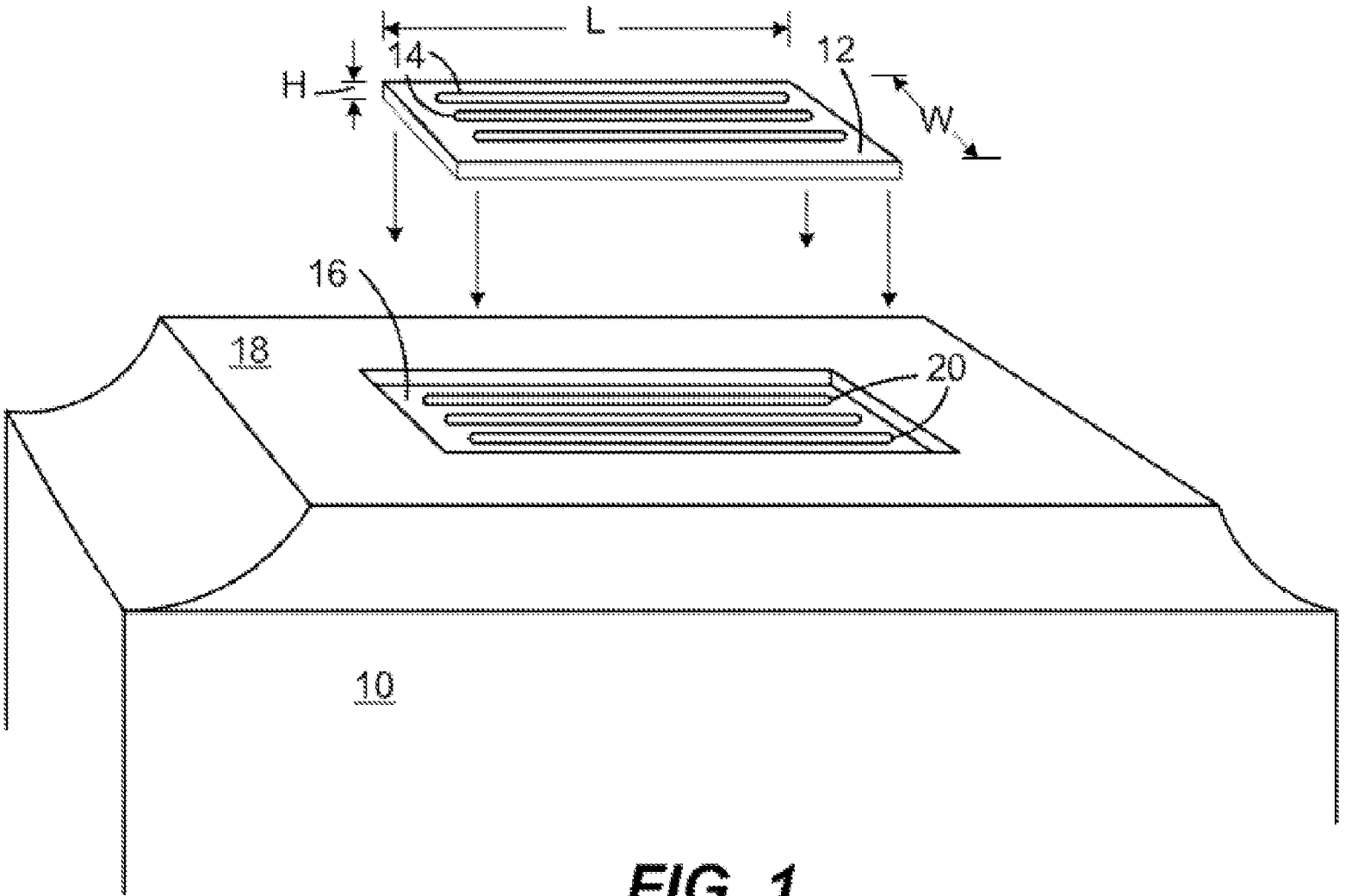
FIG. 1 Prior Art
FIGS. 1 and 2 are perspective views, not to scale, of a micro-fluid ejection chip and prior art thermoplastic body to which the chip is attached.
Figure 2:
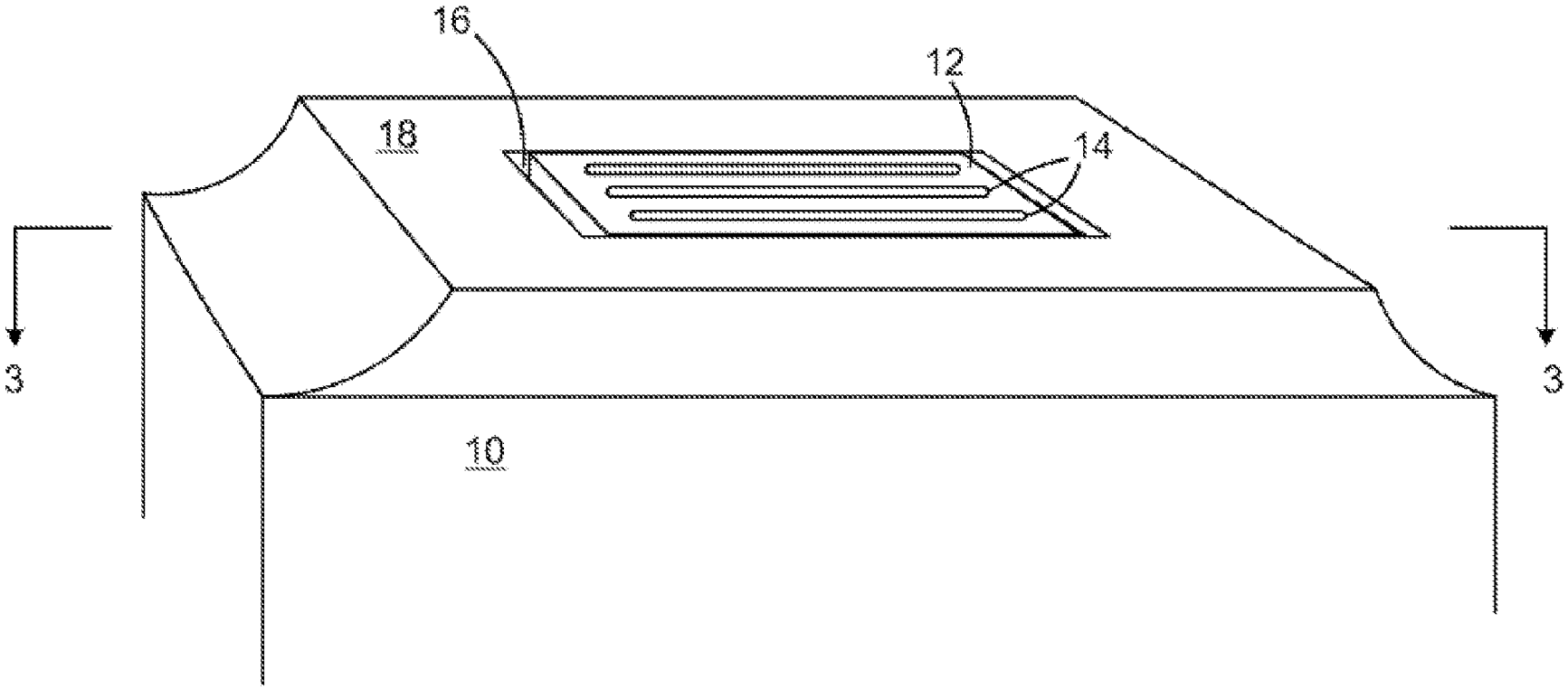
FIG. 2 Prior Art

A prior art thermoplastic body 10 for providing fluid to be ejected by a micro-fluid ejection head attached to the body is illustrated in FIGS. 1 and 2. For simplification purposes only, the term "chip" is used interchangeably with the term "substrate" and is intended to include the substrate, fluid ejectors on the substrate, and nozzle plate attached to the substrate that collectively provides a micro-fluid ejection head. Details of the micro-fluid ejection head components are well known in the art and thus are not reproduced here.

Substrates 12 may be made of semiconductor or ceramic materials and are fragile compared to the body 10. Accordingly, care must be taken to assure that the substrates are not damaged during assembly of the micro-fluid ejection heads. In order to simplify the description, only the substrate 12 portion of the micro-fluid ejection head is shown in the drawings.

The substrate 12 is relatively small and may have a length (L) of from about 10 to about 100 millimeters by from about 5 to about 10 millimeters in width (W) by from about 200 to about 800 microns in thickness (T). The substrate 12 includes one or more fluid feed slots 14, defined by etching through the thickness T of the substrate 12, for supplying fluid from the body 10 to ejection actuators on a device surface of the substrate 12. In FIG. 1, three slots in the substrate 14 are illustrated, however, the substrate 12 may have more or fewer of the slots 14.

The ejection head including the substrate 12 is attached to the body 10 in a chip pocket 16 or recessed area in a surface 18 of the body 10. The chip pocket 16 also includes slots 20 for supplying fluid from the body 10 to the ejection head substrate 12 corresponding to the slots 14 in the substrate 12. A thermally curable die bond adhesive 22 (FIG. 3) is used to attach the substrate 12 to the body 10 in the chip pocket 16 to provide the assembled structure illustrated in FIG. 2.

The die bond adhesive 22 may be an epoxy adhesive such as a die bond adhesive available from Emerson & Cuming of Monroe Township, N.J. under the trade name ECCOBOND 3193-17. The thickness of adhesive 22 in the chip pocket 16 may range from about 25 microns to about 125 microns. Heat is typically required to cure the adhesive 22 and fixedly attach the substrate 12 to the body 10 in the chip pocket 16.

The body 10 may be made of a polymeric material, such as amorphous thermoplastic polyetherimide materials available from G.E. Plastics of Huntersville, N.C. under the trade name ULTEM 1010, glass filled thermoplastic polyethylene terephthalate resin materials available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene ether/polystyrene alloy resin available from G.E. Plastics under the trade names NORYL SE1 and NORYL 300X and polyamide/polyphenylene ether alloy resin available from G.E. Plastics under the trade name NORYL GTX. A particularly suitable material for making the body 10 is ULTEM 1010 polymer. A body 10 made of ULTEM 1010 polymer has a coefficient of thermal expansion (CTE) of about 42 microns/meter per ° C. as determined by ASTM E-831. By contrast, the substrate 12 may have a CTE of about 2 to about 3 microns/meter per ° C. as determined by ASTM C-372.

Figure 3:
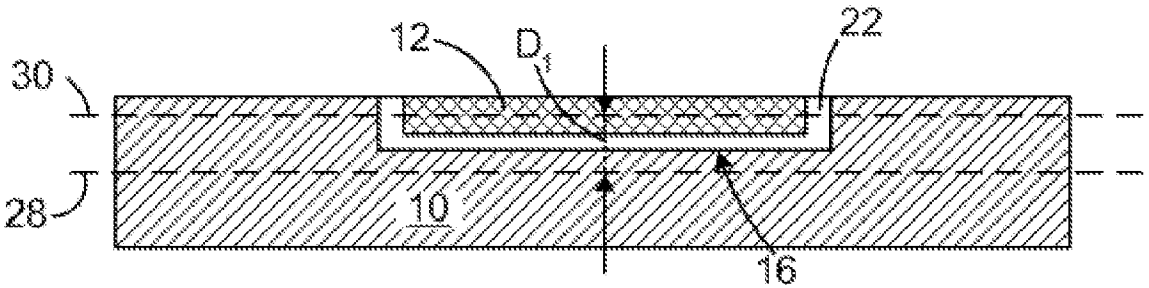
FIG. 3 Prior Art
FIG. 3 is a cross-sectional view, not to scale, of a portion of the prior art body and chip of FIGS. 1 and 2.
Figure 4:
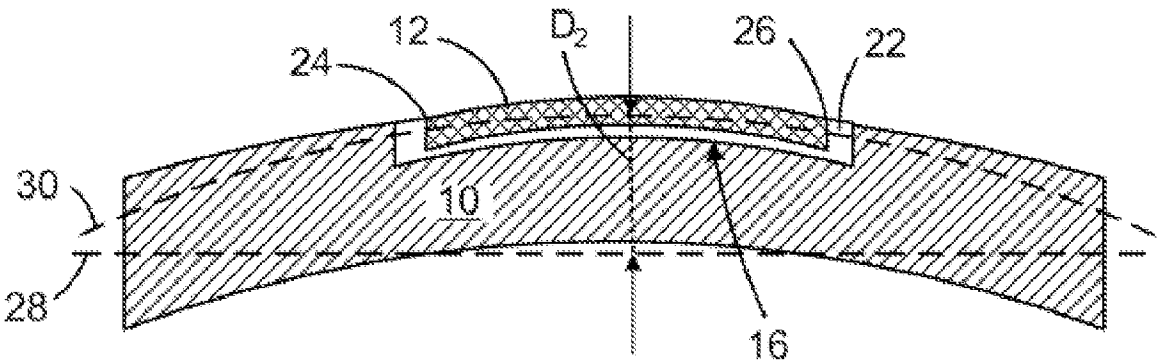
FIG. 4 Prior Art
FIG. 4 is a cross-sectional view, not to scale, illustrating warping of a prior art body and chip during an adhesive curing procedure for attaching the chip to the body.

As will be appreciated, the substrate 12 is supported in the chip pocket 16 mainly on opposing ends 24 and 26 of the substrate 12 due to the slots 20 in the center portions of the chip pocket 16. During a procedure for attaching the substrate 12 to the body 10, there may be a cure cycle temperature change of approximately 60° C. Such a temperature change may cause thermal expansion of the substrate 12 and the body 10. Since the body 10 has an order of magnitude higher thermal expansion coefficient than the substrate 12, shrinkage in the body 10 may be substantially greater than shrinkage of the substrate 12 as the substrate 12 and the body 10 cool. The higher shrinkage of the body 10 causes a moment on the ends 24 and 26 of the substrate 12 causing the substrate 12 to bend and bow as illustrated in FIG. 4. In FIGS. 3 and 4, centerline 28 of the body 10 is used as a reference line and the amount of warping or bowing of the substrate 12 is determined by the amount of displacement ($D_2$–$D_1$) of a centerline 30 though the substrate 12 from the centerline 28. The greater the amount of displacement ($D_2$–$D_1$) during the adhesive curing procedure, the more likely damage will occur to the substrate 12.

Despite attempts to reduce the amount of displacement ($D_2$–$D_1$) during the adhesive curing cycle, a significant problem remains. Some solutions may be to increase the thickness of the substrate 12 thereby increasing its resistance to bending. However, the substrate 12 is one of the more expensive components in terms of material and production cost and thus such as solution is not cost effective from a competitive point of view.

Another solution may be to reinforce the body 10 with additional glass fiber. However, glass fiber reinforcement may reduce the resistance of the body 10 to attack by the fluid contained in the body 10 for ejection by the micro-fluid ejection head. An attempt to reduce the distance $D_1$ between centerline 26 and centerline 24 by making the body 10 more compliant in the chip pocket 16 area may make the substrate 12 and body 10 bow or warp even more. The substrate 12 may also be attached to an additional substrate, such a ceramic block to provide a thicker substrate 12 that may avoid bowing. However, the planarity of the additional substrate to which the substrate 12 is attached may require additional tolerance and processing considerations.

Figure 5:
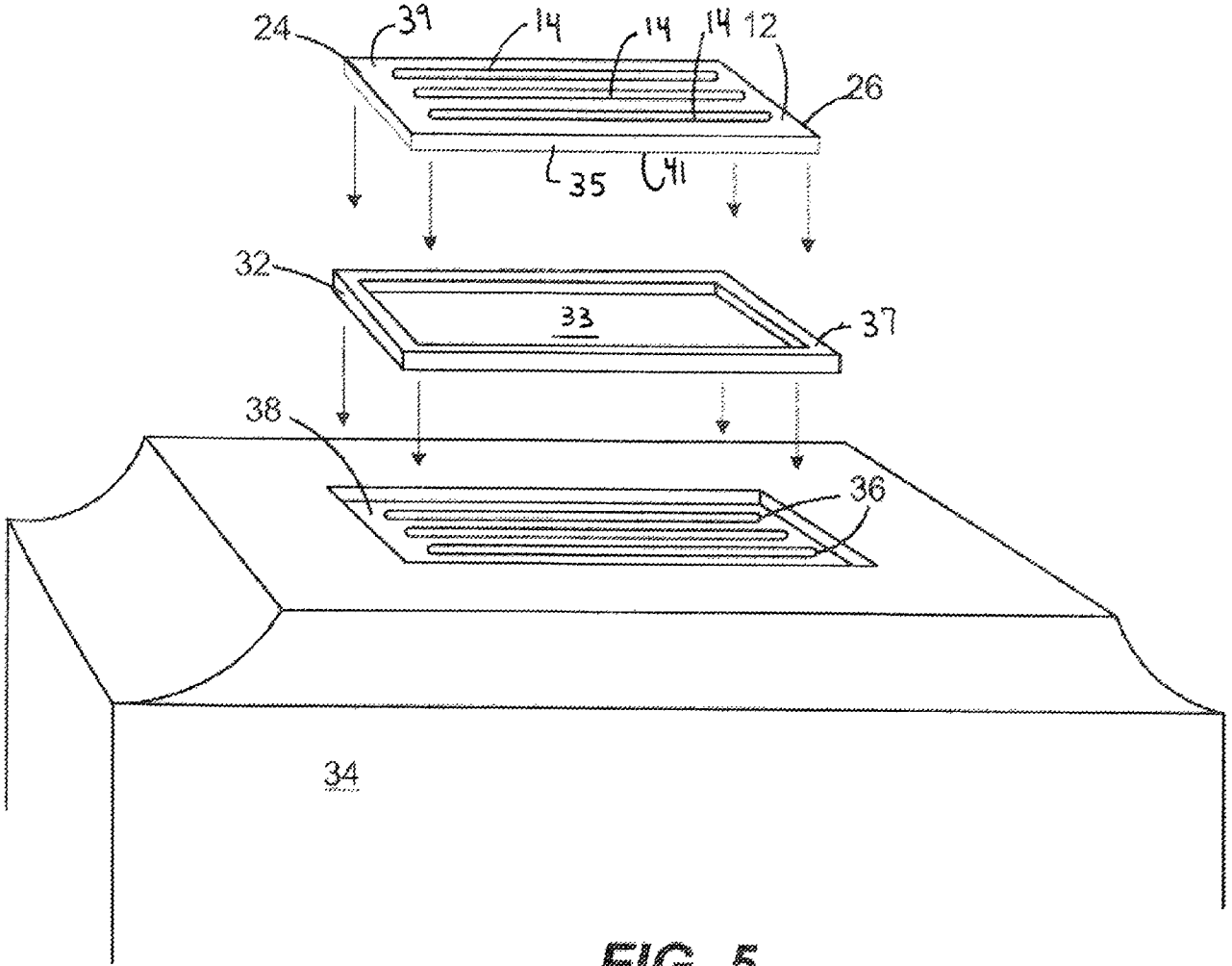
FIGS. 5 and 6 are perspective views, not to scale, of a body and chip according to one embodiment of the disclosure.
Figure 6:
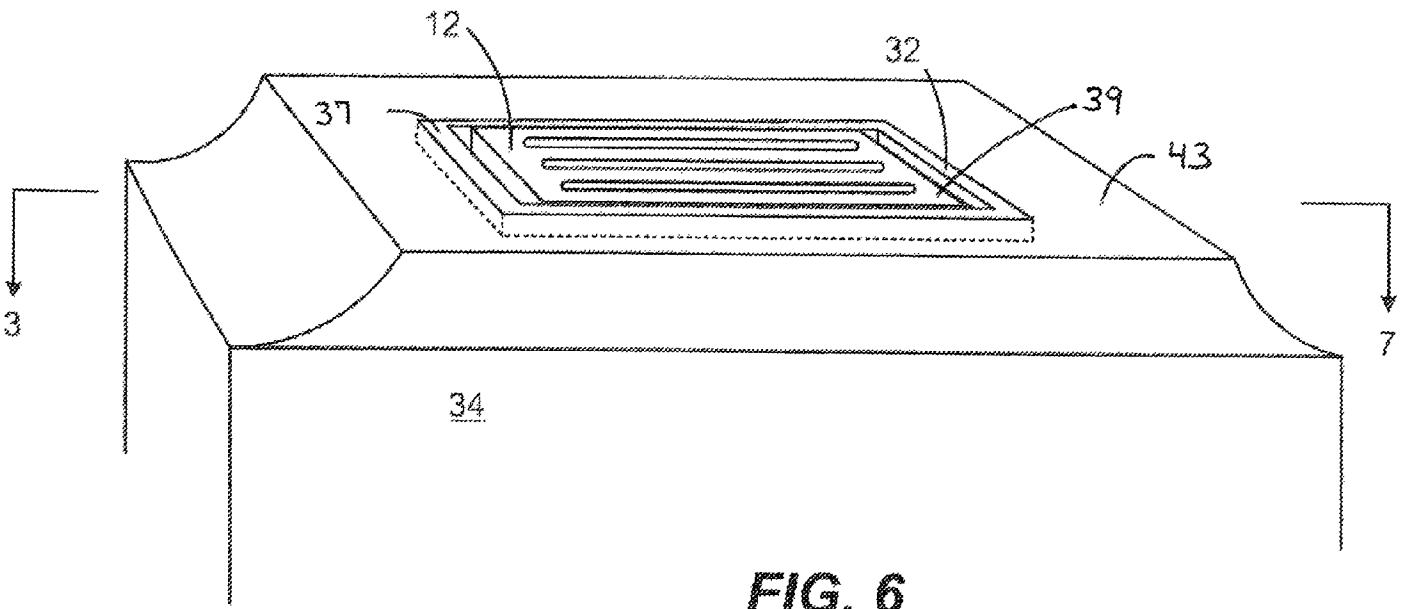

With reference now to FIGS. 5 and 6, one exemplary embodiment of the disclosure provides a reinforcing member 32 for reducing substrate bowing and or breakage during an adhesive curing cycle used to attach the substrate 12 to a body 34. According to an embodiment of the disclosure, the reinforcing member 32 may be a relatively rigid ring that circumscribes fluid feed slots 36 in the body 34. The ring defines an interior 33 having an area larger than an exterior or periphery 35 of the area of the substrate 12. The substrate fits within the interior 33 of the ring in a manner, indicated by the arrows, such that it recesses downward in the ring toward the body 34 and its periphery 35 is wholly circumscribed by the interior 33. In this manner, the underside 41 of the substrate directly contacts and bonds to the body 34 within the confines of the chip pocket 38, while at the same time providing a direct fluidic communication path between the fluid slots 14 of the substrate and the feed slots 36 of the body 34. Also, a top 37 of the ring and a top surface 39 of the substrate are fitted to remain relatively coplanar with one another and both reside fairly flush with an exterior surface 43 of the body 34. The reinforcing member 32 may be made of a variety of high flexural modulus materials such as metals, ceramics, silicon, and the like. A particularly suitable reinforcing member 32 is a steel or stainless steel ring that may be adhesively attached or insert molded adjacent to a chip pocket 38 of the body 34.

While not desiring to be bound by theoretical considerations, it is believed that the reinforcing member 32 may be effective to decouple expansion forces of the body 34 from the ends 24 and 26 of the substrate 12 thereby reducing the amount of bowing experienced by the substrate 12 during the adhesive curing procedure. It is the ends 24 and 26 of the substrate 12 (where the diebond adhesive terminates) where a rigid wall boundary condition needs to be reinforced to reduce the amount of substrate bowing. Accordingly, the reinforcing member 32 may be disposed in the chip pocket 38 so that it at least partly or completely circumscribes the substrate 12. When the reinforcing member 32 is made of a high modulus material, opposing ends 40 and 42 of the chip pocket 38 have reduced influence on the substrate 12 due to a reduced amount of deformation of the body 34 in the chip pocket area 38.

Another advantage of using the reinforcing member 32 is that the member 32 may partly or completely decouple the substrate 12 from the body 34 in the chip pocket 38 so that bowing is reduced. If the member 32 is made of a thermally conductive material, more rapid cooling of the substrate 12 during fluid ejection operations may be obtained.

The following non-limiting examples are given in order to illustrate aspects of the disclosed embodiments.

Example 1

A comparison of the amount of chip bowing for a prior art body, a body having a compliant chip pocket and a body containing a reinforcing member is given in the following table. The amount of bowing in the prior art chip pocket (FIGS. 1-4) is used as a baseline for comparing other chip pocket designs. In the table, the maximum distance between of the centerlines 28 and 30 is used as the maximum substrate bowing in the table for each of the indicated chip pocket designs at a 60° temperature difference applied for adhesive curing. A steel reinforcing member 32 is used to reinforce the chip pocket for the rigid chip pocket design.

TABLE 1

| Chip Pocket Design | Max. Bowing (microns) | % decrease/increase |
|---|---|---|
| Prior art chip pocket (FIGS. 1-4) | 10 | Baseline |
| Compliant chip pocket | 13 | 30% increase |
| Rigid chip pocket (FIGS. 5-8) | 6 | 40% decrease |

Figure 7:
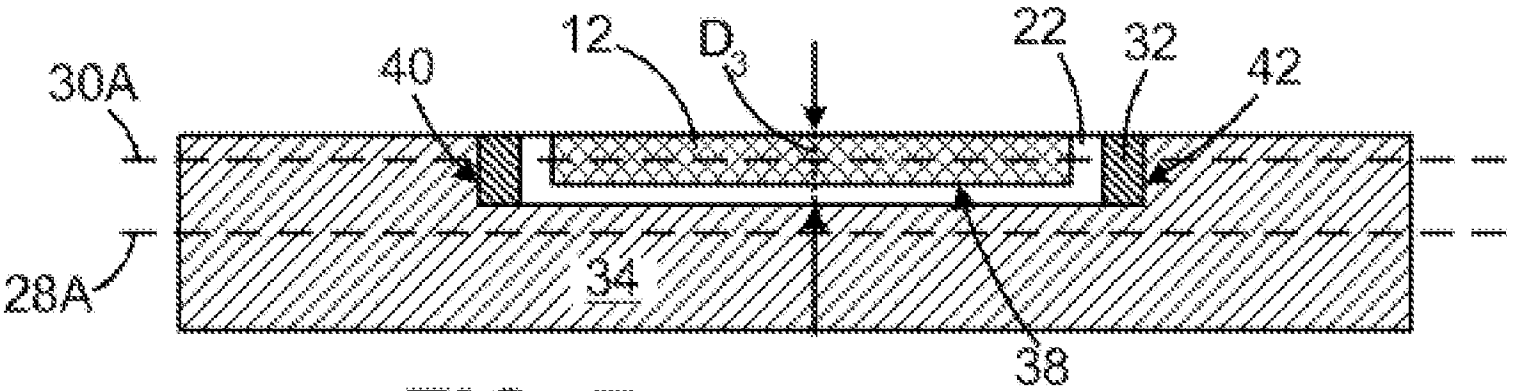
FIG. 7 is a cross-sectional view, not to scale, of a portion of the body and chip of FIG. 6.
Figure 8:
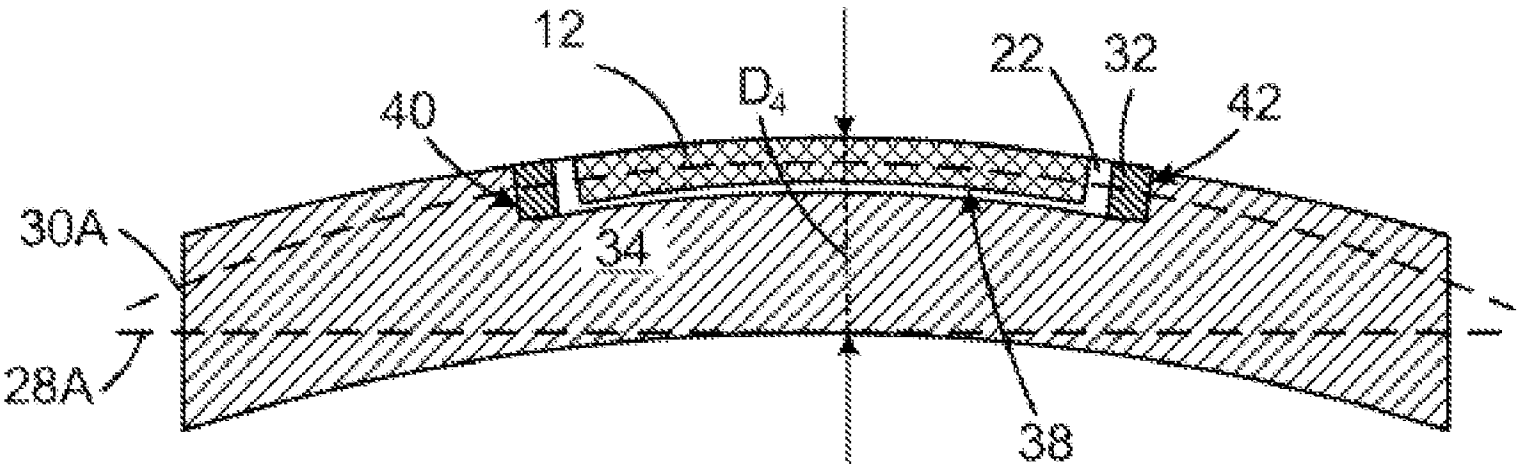
FIG. 8 is a cross-sectional view, not to scale, illustrating warping of a body and chip during an adhesive curing procedure for attaching the chip to the body according to an embodiment of the disclosure.

From the foregoing table, it is evident that use of a substantially rigid reinforcing ring 32 in the chip pocket 38 of the body 34 provides a substantial decrease in chip bowing as illustrated in FIGS. 7 and 8. FIGS. 7 and 8 illustrate a displacement ($D_4$–$D_3$) during the adhesive curing cycle for the body 34 containing the reinforcing member 32 as provided in Table 1.

Example 2

In the following example, an effect of the use of glass fiber reinforcing of the chip pocket 38 and the use of different thicknesses of ceramic reinforcing members 32 is compared. The adhesive curing conditions were the same as in Example 1.

TABLE 2

| Configuration | Max. deflection (microns) | Min. deflection (microns) | Delta deflection (Max. – Min) (microns) |
|---|---|---|---|
| Prior art chip pocket FIGS. (1-4) | 28.5 | 16.5 | 12 |
| Prior art chip pocket (20 wt. % glass filled) | 13.8 | 8.5 | 5.36 |
| Prior art chip pocket (30 wt. % glass filled) | 8.7 | 5.44 | 3.26 |
| 0.6 mm thin ceramic ring (20 wt. % glass filled) | 9.5 | 5.3 | 4.2 |

TABLE 2-continued

| Configuration | Max. deflection (microns) | Min. deflection (microns) | Delta deflection (Max. – Min) (microns) |
|---|---|---|---|
| 1.2 mm thick ceramic ring (20 wt. % glass filled) | 8.8 | 4.4 | 4.4 |
| 1.2 mm thick ceramic ring (0 wt. % glass filled) | 14 | 6.5 | 7.5 |

As shown by the foregoing example, reinforcing the chip pocket with 20 wt. % glass fiber fill, 30 wt. % fiberglass and/or a ceramic ring or a combination of ceramic ring and glass fiber fill is effective in substantially reducing the delta deflection of the body and substrate during an adhesive curing procedure for attaching the substrate 12 to a thermoplastic body.

Example 3

In the following example, an effect of the use of the substrate thickness on the bowing characteristics is compared. The adhesive curing conditions were the same as in Example 1.

TABLE 3

| Configuration | Max. deflection (microns) | Min. deflection (microns) | Delta deflection (Max. – Min) (microns) |
|---|---|---|---|
| Prior art chip pocket 450 micron thick substrate 12 (20 wt. % glass filled) | 13.8 | 8.5 | 5.36 |
| Prior art chip pocket 450 micron thick substrate 12 (30 wt. % glass filled) | 8.7 | 5.44 | 3.26 |
| 0.6 mm thin ceramic ring (20 wt. % glass filled) | 9.5 | 5.3 | 4.2 |
| Prior art chip pocket 450 micron thick substrate 12 (20 wt. % glass filled) | 0.925 | 0.45 | 0.5 |
| Prior art chip pocket 625 micron thick substrate 12 (20 wt. % glass filled) | 13.5 | 8.5 | 5.0 |

As illustrated by the foregoing table, increasing the thickness of the substrate 12 has little impact on the delta deflection amount of the substrate during adhesive curing. However, the glass fiber filled chip pockets and chip pockets containing ceramic rings have substantially improved delta deflection amount. The best results are obtained by a combination of substrate thickness, glass fiber filled chip pockets, and chip pockets containing ceramic rings. However, the amount of glass fiber that may be used to reinforce the chip pocket is suitably limited to less than a saturation point of glass fiber in the polymeric material used for the body. Above the saturation point, glass fiber may stay on the surface of the polymeric material and be easily removable from the polymeric material or may react with the fluid as fluid flows in contact with the chip pocket thereby contaminating the fluid.

In addition to the improved deflection properties obtained by the use of the reinforcing member 32, the reinforcing member 32 may also be effective to shield the substrate 12 or absorb shock or impact forces if the body 34 containing the attached substrate 12 is dropped. Another advantage of using a reinforcing member 32 in the shape of a ring, rather than a ceramic material to which the substrate 12 is attached to reduce substrate bowing is that, when the reinforcing member 32 is in the shape of a ring the substrate 12 is attached directly to the body 34 in the chip pocket 38, hence flatness or planarity requirements for the reinforcing member 32 are avoided.

Figure 9:
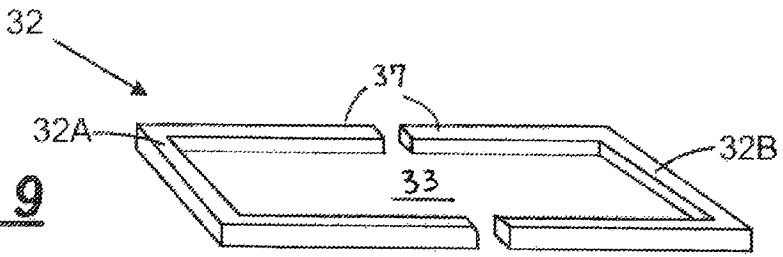
FIG. 9 is a perspective view, not to scale, of reinforcing members according to an alternative embodiment of the disclosure.

While it is desirable that the reinforcing member 32 completely circumscribe the substrate 12 in the chip pocket, it will be appreciated that the reinforcing member may be made of multiple sections 32A and 32B which substantially circumscribe the substrate 12 as illustrated in FIG. 9.

Figure 11:
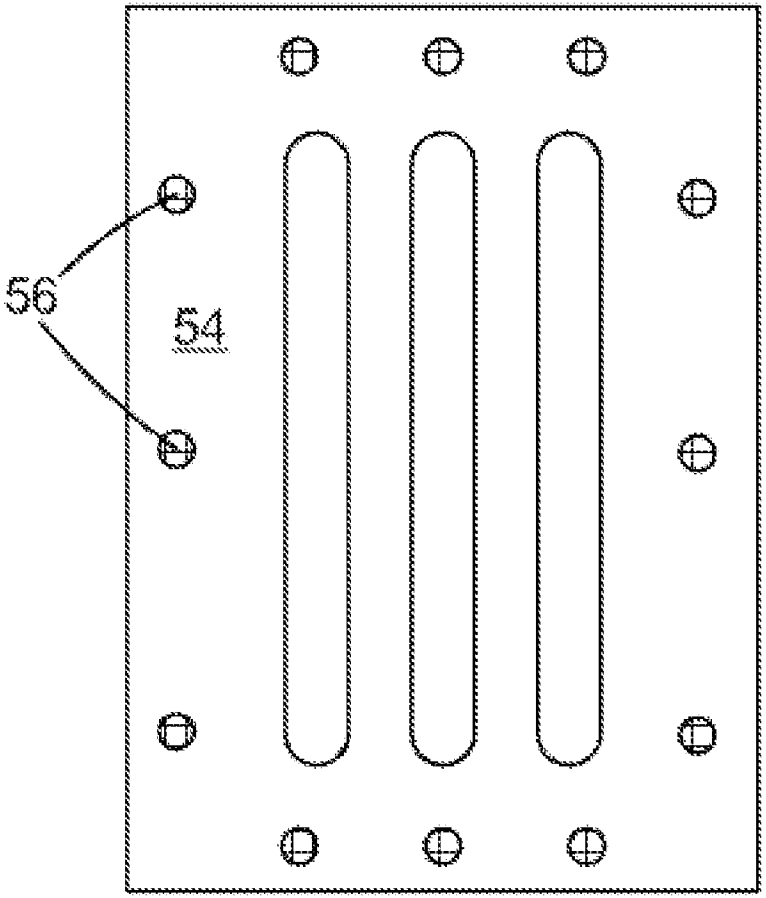
FIG. 11 is a plan view, not to scale, of a chip pocket for the reinforcing member of FIGS. 5 and 6.
Figure 10:
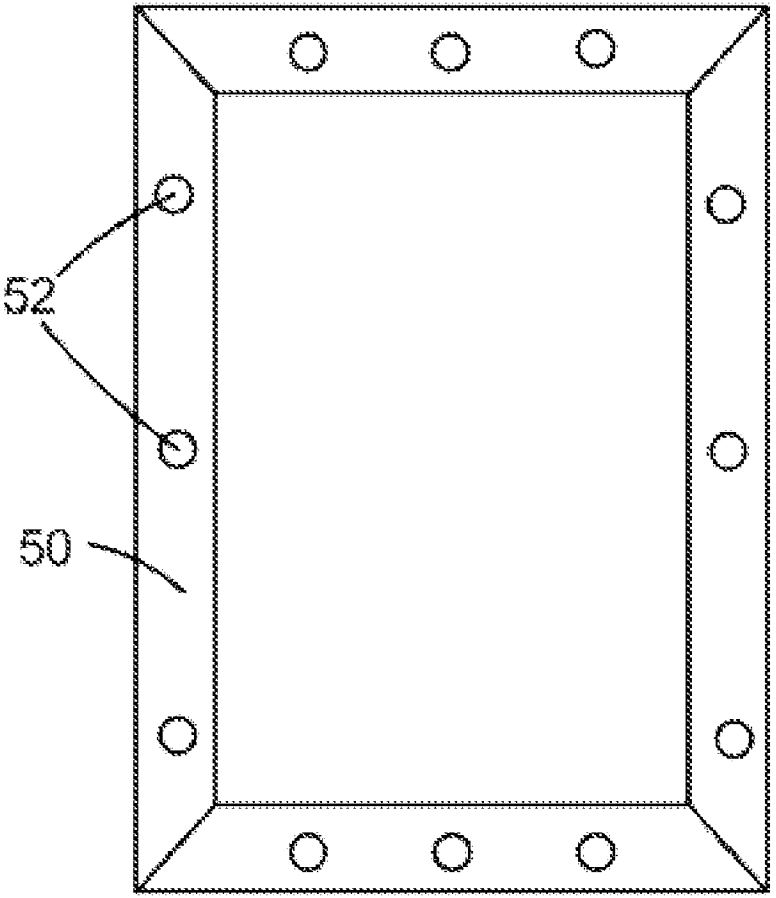
FIG. 10 is a plan view, not to scale of a reinforcing member according to another embodiment of the disclosure.

What is important in the use of the reinforcing member 32 is the reinforcing member remain in intimate contact with the body 34 in the chip pocket 38. Debonding of the reinforcing member 32 from the body 34 may cause the body 34 and substrate 12 to deform more than if the member 32 remains in intimate contact with the body 34. Intimate contact between member 32 and body 34 may be achieved by insert molding of the reinforcing member 32 into the body 34 or, as illustrated in FIGS. 10 and 11, by adhesively attaching a reinforcing member 50 containing a plurality of holes 52 therein to a chip pocket 54 containing corresponding pins 56. In order for the member 50 to debond from the chip pocket 54, debonding forces will have to overcome shear forces provided by the pins 56. The pins 56 may also be helpful during an assembly process of attaching the member 50 in the chip pocket 54 if the member 32 is not insert molded into the body 34. In an alternative, the member 50 containing holes 52 may be inserted molded into the body 34. In another alternative, the reinforcing member may contain the pins 56 and the chip pocket 54 may contain the holes 52 for pin insertion therein.

The foregoing embodiments are susceptible to considerable variation in their practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A micro-fluid ejection head assembly comprising:

a fluid supply body having at least one fluid supply port in a recessed area therein;

a reinforcing member substantially circumscribing the fluid supply port; and a substrate attached with an adhesive to the supply body in a chip pocket of the recessed area, wherein the reinforcing member defines a ring having an interior with an area larger than a periphery of the substrate so that the substrate can fit within the interior of the ring and an underside of the substrate can directly contact the fluid supply body and bond to the fluid supply body with said adhesive thereby forming a fluid communication path between the at least one fluid supply port and a fluid slot of the substrate, the reinforcing member being a material selected from the group consisting of metals, ceramics, and silicon materials.

2. The micro-fluid ejection head assembly of claim 1, wherein the reinforcing member comprises one or more members.

3. The micro-fluid ejection head assembly of claim 1, wherein a top of the ring is substantially coplanar with a top surface of the substrate and flush with an exterior surface of the fluid supply body.

4. The micro-fluid ejection head assembly of claim 1, wherein the reinforcing member is injection molded into the fluid supply body.

5. The micro-fluid ejection head assembly of claim 1, wherein the reinforcing member is adhesively attached in the recessed area to the fluid supply body.

6. The micro-fluid ejection head assembly of claim 1, wherein the fluid supply body comprises a polymeric material.

7. The micro-fluid ejection head assembly of claim 1, wherein the reinforcing member comprises a plurality of receiving holes and the fluid supply body comprises a plurality of pins corresponding to the receiving holes in the reinforcing member.

8. A method of making a micro-fluid ejection assembly, comprising:

providing a fluid supply body having a fluid supply port in a recessed area thereof therein and a reinforcing member defining a ring substantially circumscribing the fluid supply port, the reinforcing member being a material selected from the group consisting of metals, ceramics, and silicon materials;

fitting an entire periphery of a device substrate within an interior of the ring;

directly contacting an underside of the substrate to the fluid supply body in a chip pocket of the recessed area such that a top of the ring and a top surface of the substrate are substantially coplanar; and adhesively attaching the underside of the substrate to the fluid supply body in the recessed area to form a fluid communication path between the fluid supply port and a fluid slot of the substrate.

9. The method of claim 8, wherein the fluid supply body comprises a fiberglass reinforced polymeric material.

10. The method of claim 8, wherein the reinforcing member comprises one or more members circumscribing the recessed area.

11. The method of claim 8, wherein the reinforcing member is injection molded into the fluid supply body.

12. The method of claim 8, wherein the reinforcing member is adhesively attached to the fluid supply body in the recessed area.

13. The method of claim 8, wherein the fluid supply body comprises a polymeric material.

14. The method of claim 8, wherein the reinforcing member comprises a plurality of receiving holes and the fluid supply body comprises a plurality of pins corresponding to the receiving holes in the reinforcing member.

* * * * *